US009186566B2

(12) United States Patent
Boehner

(10) Patent No.: US 9,186,566 B2
(45) Date of Patent: Nov. 17, 2015

(54) SYSTEM AND METHOD TO PITCH FOOTBALLS

(71) Applicant: Sports Attack, Inc., Verdi, NV (US)

(72) Inventor: Douglas L Boehner, Verdi, NV (US)

(73) Assignee: Sports Attack, Inc., Verdi, NV (US)

( * ) Notice: Subject to any disclaimer, the term of this patent is extended or adjusted under 35 U.S.C. 154(b) by 0 days.

(21) Appl. No.: 14/522,861

(22) Filed: Oct. 24, 2014

(65) Prior Publication Data

US 2015/0096546 A1 Apr. 9, 2015

Related U.S. Application Data

(63) Continuation of application No. 13/658,848, filed on Oct. 24, 2012, now Pat. No. 8,932,156.

(60) Provisional application No. 61/554,451, filed on Nov. 1, 2011.

(51) Int. Cl.

| | |
|---|---|
| ***A63B 69/00*** | (2006.01) |
| ***F41B 15/00*** | (2006.01) |
| ***A63B 69/40*** | (2006.01) |
| *A63B 47/00* | (2006.01) |
| *A63B 71/00* | (2006.01) |
| *A63B 71/02* | (2006.01) |
| *A63B 71/06* | (2006.01) |

(52) U.S. Cl.

CPC ..... *A63B 69/406* (2013.01); *A63B 69/002* (2013.01); *A63B 47/002* (2013.01); *A63B 2069/402* (2013.01); *A63B 2071/009* (2013.01); *A63B 2071/025* (2013.01); *A63B 2071/0627* (2013.01); *A63B 2220/00* (2013.01); *A63B 2220/17* (2013.01); *A63B 2220/64* (2013.01); *A63B 2220/72* (2013.01); *A63B 2220/803* (2013.01); *A63B 2220/806* (2013.01); *A63B 2220/833* (2013.01); *A63B 2225/093* (2013.01); *A63B 2225/70* (2013.01); *A63B 2243/007* (2013.01)

(58) Field of Classification Search

CPC .. A63B 69/408; A63B 69/0075; A63B 69/40; A63B 69/002

USPC ..... 473/436, 451, 419, 420, 438, 422; 124/78

See application file for complete search history.

(56) References Cited

U.S. PATENT DOCUMENTS

| | | | | |
|---|---|---|---|---|
| 3,399,892 | A * | 9/1968 | Jurkiewicz | 473/438 |
| 3,439,916 | A * | 4/1969 | Kopp | 473/419 |
| 3,977,386 | A * | 8/1976 | Meyer | 124/7 |
| 4,723,532 | A * | 2/1988 | Osojnak | 124/78 |
| 5,613,678 | A * | 3/1997 | McKee et al. | 473/397 |
| 6,718,961 | B1 * | 4/2004 | Woods et al. | 473/438 |
| 2006/0035733 | A1 * | 2/2006 | Silver et al. | 473/438 |
| 2013/0109510 | A1 * | 5/2013 | Boehner | 473/436 |

* cited by examiner

*Primary Examiner* — Mitra Aryanpour

(74) *Attorney, Agent, or Firm* — Marc D. Foodman

(57) ABSTRACT

A system and method for pitching balls, particularly footballs and other football-shaped balls. The system and method are flexibly designed to simulate different types of pitches including but not limited to passes, punts, kick-offs and snaps. A cradle for use in the system and method holds the ball in any one of a number of positions such that when it is fed into the system, the ball is propelled to simulate a different type of pitch. The apparatus and system for pitching balls includes a support for a ball throwing head, two opposing variable speed motor powered wheels that can be tilted in relation to each other to control the spin and distance, a slide configured to present the ball on the cradle into the wheels at different angles to provide right or left handed spirals and end over end pitches, and adjustments for height and horizontal pivot. A removable throwing head allows balls to be pitched from different heights from ground level to an upright arm motion to simulate different types of pitches.

29 Claims, 12 Drawing Sheets

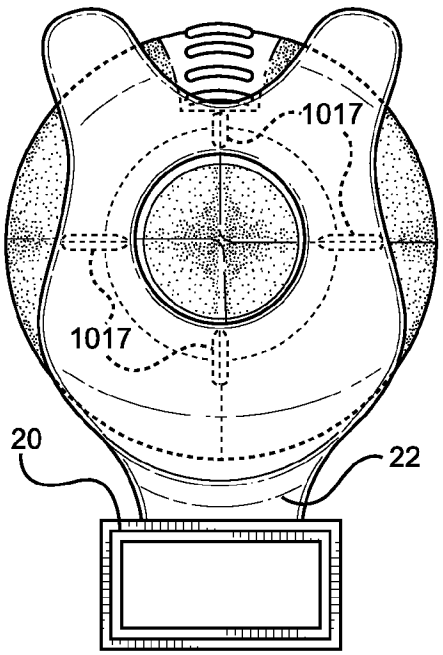
FIG. 10H2
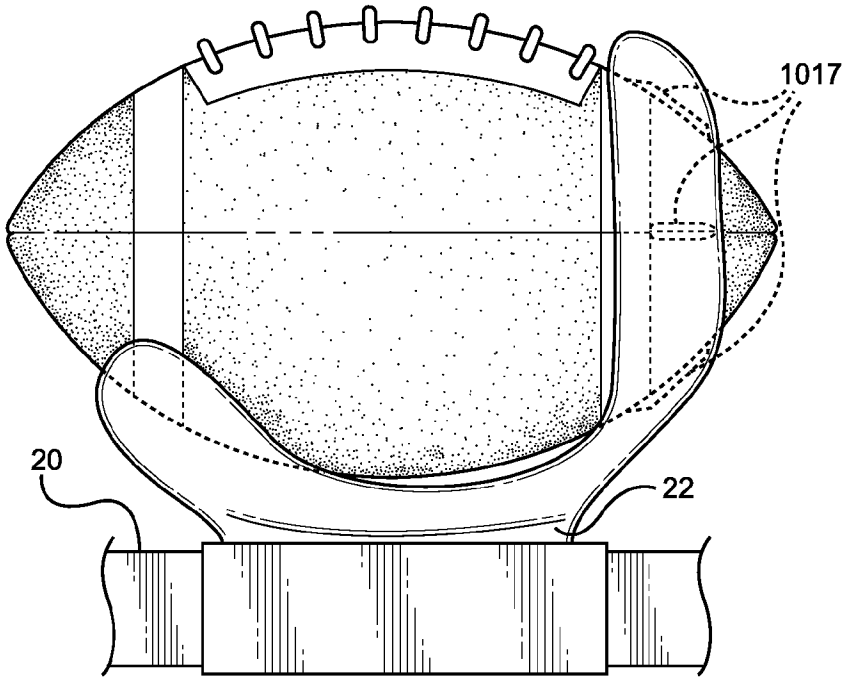
FIG. 10H1

SYSTEM AND METHOD TO PITCH FOOTBALLS

RELATED APPLICATION INFORMATION

This application is a continuation application of U.S. application Ser. No. 13/658,848 filed on Oct. 24, 2012, which claims priority benefit from U.S. Provisional Application No. 61/554,451, filed on Nov. 1, 2011.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

This invention relates to devices and methods for practicing sports, and in particular to simulating a thrown or kicked ball. In particular, the invention relates to simulating thrown, kicked, or snapped footballs, or other types of balls of a similar shape such as rugby balls.

Currently there are several devices for simulating the throwing (or pitching) of a football or rugby ball, for players to practice catching passes, snaps and kicks. For purposes of this disclosure, the term "football" will refer to a ball that is football shaped including a rugby ball or other ball that is oblong, and the terms "throwing," "pitching," "passing," "snapping" and "kicking" are used interchangeably to generally describe the motion of propelling of a football. Typically, football throwing devices have two spinning opposing wheels tilted in opposite directions that engage the ball as it passes through the wheels and impart speed and a spiral spin to the ball. These opposing wheels can be adjustably tilted in opposite directions to provide either a clockwise or counter clockwise spin to the ball simulating right handed passes or left handed passes. This is also true of the simulation of a right-footed kicker or a left footed kicker.

Further, these devices have height adjustments so that shorter legs provide a simulation of either right handed and left handed centers who snap the ball from the ground. Such devices tend to have severe drawbacks in that they do not have tight, natural spirals and when reconfigured from a mode for throwing passes to a mode for end over end kick offs, much practice time is lost. Existing devices further require time consuming part exchanges to change modes. The reconfiguration of the device with shorter legs to lower the throwing wheels does not typically lower the machine far enough to simulate an actual center who snaps the ball from ground level.

A coach using a machine of this type has tremendous time constraints. A whole team must wait while reconfiguring the device to a different mode of operation is made. A practice session with as many as 33 or more players is idled as the required reconfiguration is made. Typically the reconfiguration takes several minutes depending on the skill of the operator and the availability of tools. In total, as much as an hour of team practice time during a full practice session may be lost while multiple reconfigurations are performed during the practice session. Therefore, a machine that allows for fast change-over between modes including passing, snapping and kicking would be of great benefit.

One method to eliminate lost practice time is to have a ball holding device and method enabled to present the ball on a multi-position cradle that feeds the ball into the throwing wheels positioned either horizontally for spirals or at various angles for end-over-end kicks. Instant ball angle change capability would be of great benefit to the coach and team. A method that quickly lowers the machine to ground level would also be of great benefit.

SUMMARY

The present invention provides an apparatus and method for throwing football shaped balls that may be presented to a player or groups of players in need of rapid repetition in individual and team drills that are difficult to manually replicate repeatedly. The apparatus and system for pitching balls includes a support for a ball throwing head, two opposing variable speed motor powered wheels that can be tilted in relation to each other to control spin and distance, a slide configured to present the ball into the wheels at different angles to provide right or left handed spirals and end-over-end pitches. A slotted height control adjustment and a horizontal pivot control adjustment are also included. Combined, these adjustments form a gimbal allowing for different ball throwing trajectories. A removable stand allows the machine to be lowered to ground level simulating a center snapping to a place kicker, a punter or a quarterback as well as any other type of pitch or snap from ground level. This invention also provides wheel guards to protect the operator from injury. Two caddy wheels are included, providing easy mobility.

BRIEF DESCRIPTION OF THE DRAWINGS

For a better understanding of the present invention, and to show more clearly how it is configured and functions, reference will now be made, by way of example, to the accompanying drawings. The drawings show embodiments of the present invention in which:

FIGS. 10D-10G are several views of the ball cradle with the ball in position for pitching and FIGS. 10H1 and 10H2 show an alternative embodiment for the cradle to hold a football;

DETAILED DESCRIPTION

Figure 1:
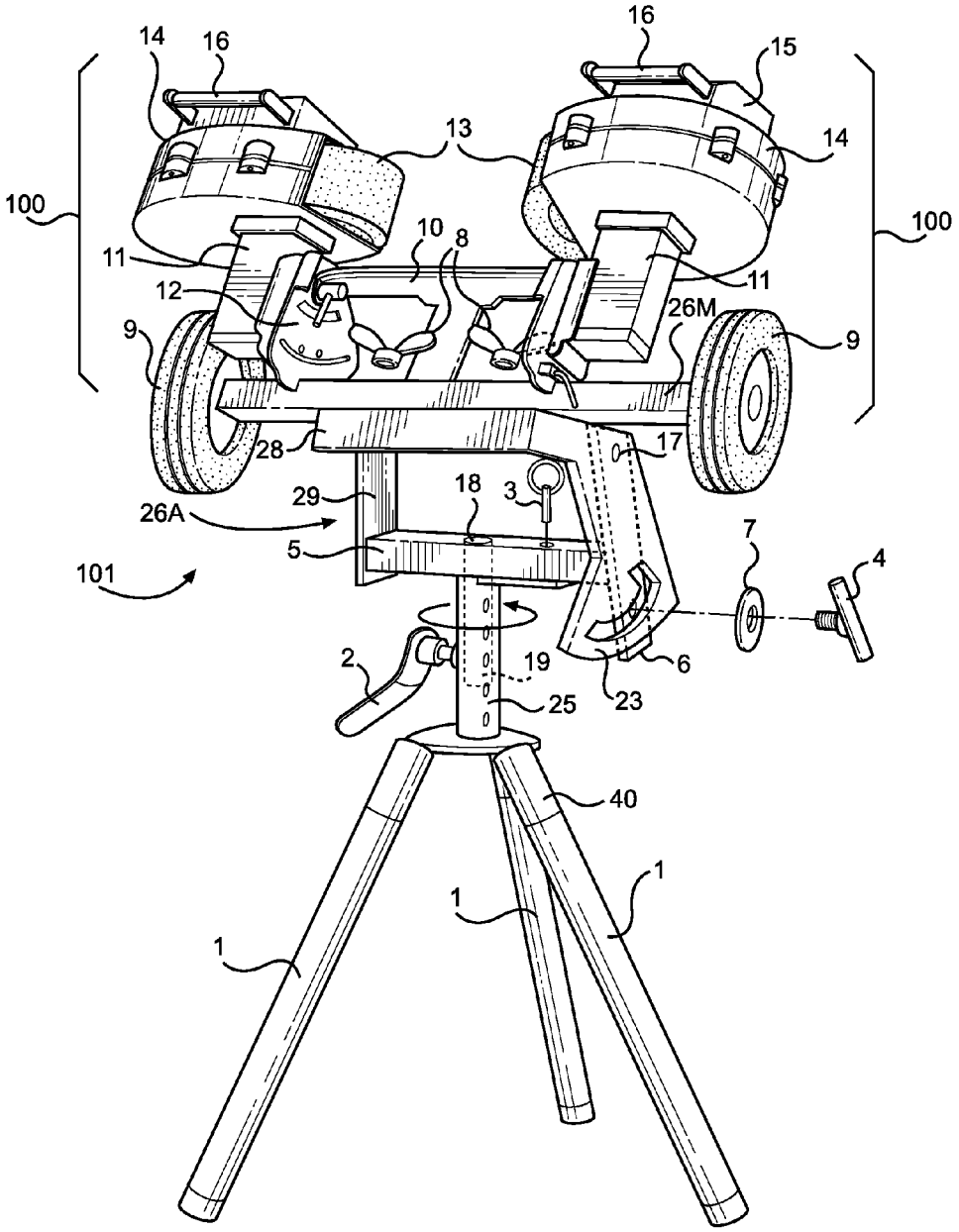
FIG. 1 is a front perspective view of the system to pitch balls.

FIG. 1 is a front perspective view of a football pitching machine 101 in accordance with the present invention. Football pitching machine 101 has three telescoping legs 1 configured to provide a tripod base and a socketing frame 40 to receive legs 1 and formed with three socketing tubes. An adjustment handle 2 locks a swivel shaft 19 (shown in dashed lines) in place that fits inside an upper tube 25 on socketing frame 40, which is attached to an adjustment yoke 26A at the top of swivel shaft 19. Adjustment yoke 26A is formed from a number of parts including lower crossbar 5, upper crossbar 28, fixed side panels 6, 29 and adjustable tilt panel 23. Adjustment yoke 26A may be attached to and detached from mobility yoke 26M with attachment wing nuts 8. A throwing head 100 is affixed to the top of mobility yoke 26M formed from a number of parts including mobility yoke side panels 12 and a mobility yoke top panel 10. A pair of throwing wheels 13 is mounted above mobility yoke 26M and each is controlled respectively by a variable speed motor 11. Throwing wheels 13 have safety guards 14 around them to prevent a user's hands or other body parts from coming into contact with throwing wheels 13. To facilitate mobility or detaching the throwing head from mobility yoke 26M are two tilting handles 16 that may be gripped during the detachment or lowering process. Also attached to either end of mobility yoke 26M are a pair of caddy wheels 9 for portability.

Figure 2:
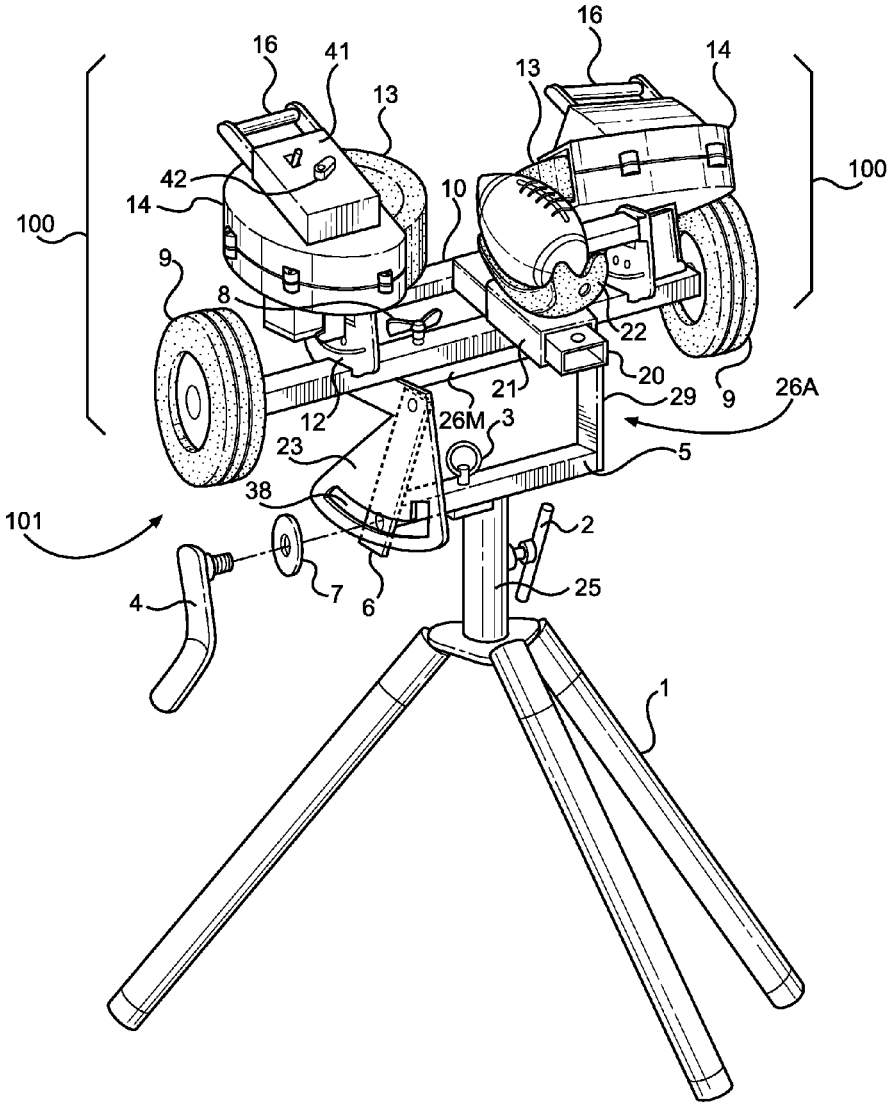
FIG. 2 is a rear perspective view of the system to pitch balls.

FIG. 2 is a rear perspective view of the system to pitch footballs showing a ball cradle 22 mounted on a base 21 which slides along a slide tube 20 to present the football into a chute formed between throwing wheels 13. Also shown is a speed control knob 42 on electronics enclosure 41 that adjusts the speed (RPM) of each motor that may be turned to increase or decrease the speed of motors 11 thereby causing longer or shorter passes, snaps or kicks.

Figure 3:
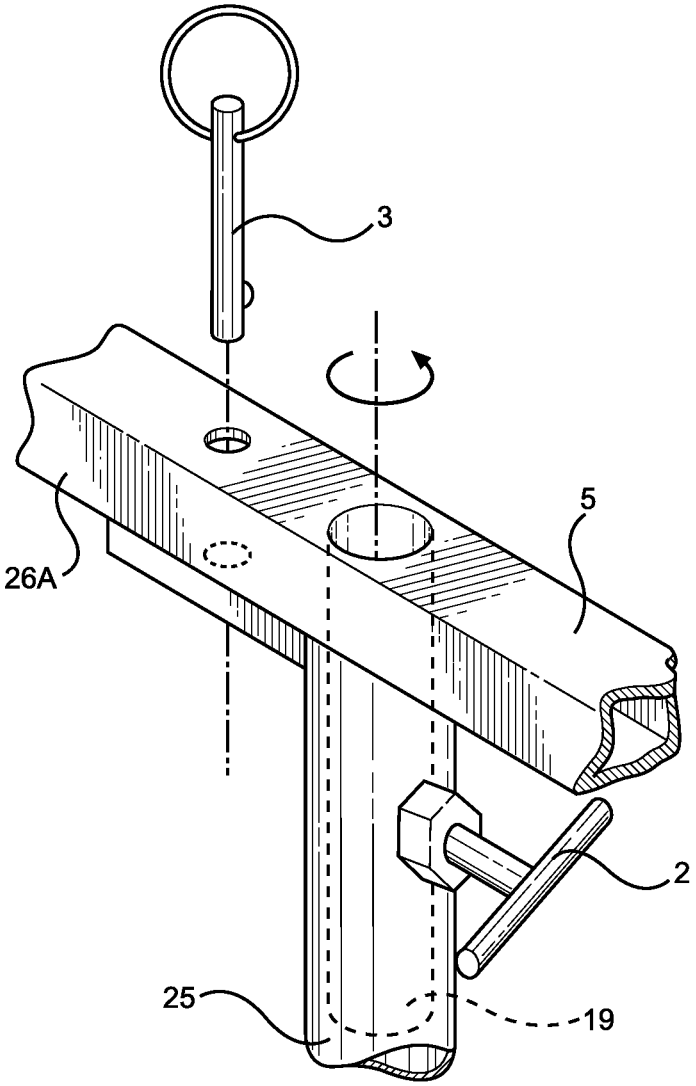
FIG. 3 is a perspective exploded view of the horizontal pivot adjustment on the system to pitch balls.

FIG. 3 is a close-up perspective exploded view of the horizontal pivot adjustment on the system to pitch footballs. Loosening of horizontal adjustment handle 2 allows lower crossbar 5 of adjustment yoke 26A to pivot in either direction thereby controlling the horizontal trajectory of the football. Adjustment yoke 26A has a hole matching holes through lower crossbar 5 and aligned so spring bolt 3 can pass through, thereby locking adjustment yoke 26A in place. This eliminates pivoting in preparation for transporting system 101.

Figure 4A:
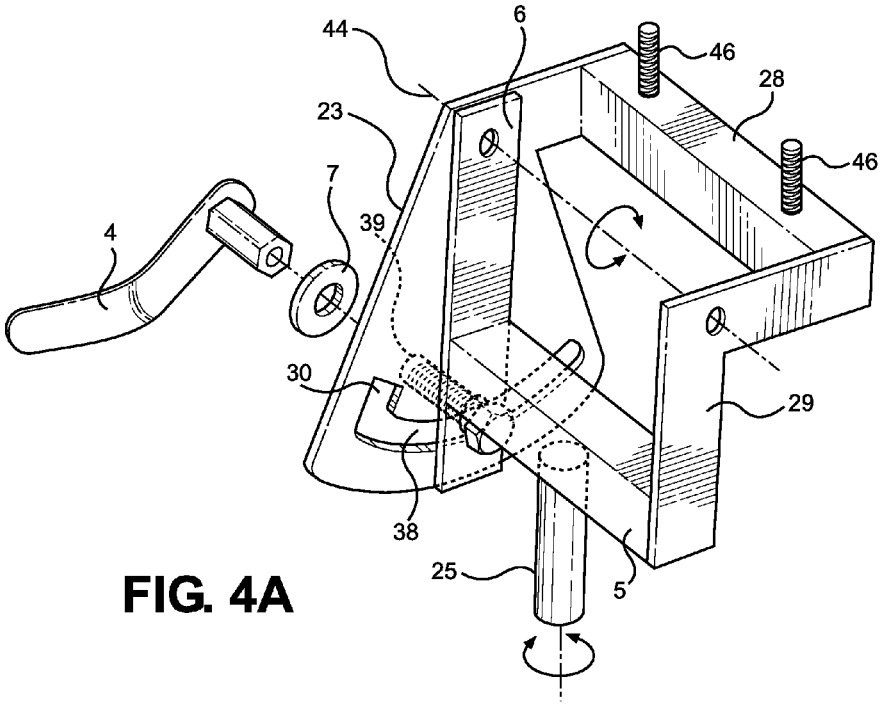
FIG. 4A is a perspective exploded view and FIG. 4B is a side view of the height control adjustment on the system to pitch balls.
Figure 4B:
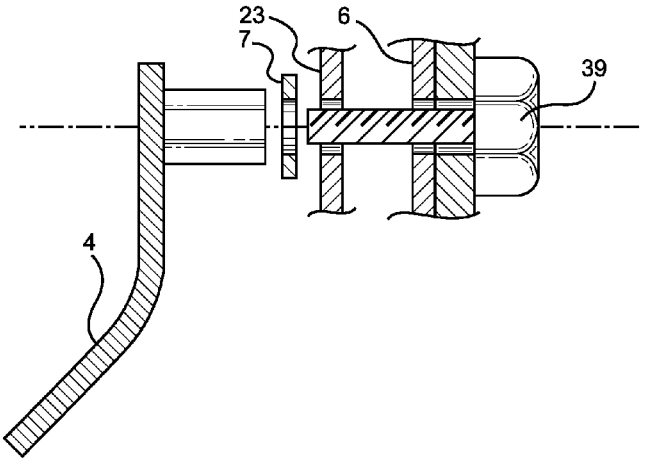

FIG. 4A and FIG. 4B show a close-up perspective exploded view and a side view of the height control adjustment on the system to pitch footballs, respectively. Loosening vertical adjustment handle 4 allows adjusting tilt panel 23 to pivot. As adjusting tilt panel 23 pivots around pivot point 44, handle 4 may be tightened on tilt panel bolt 39 at any point along tilt panel slot 38 to hold adjustable yoke 26A in place. When the tilt angle for the pitching of a ball is required to be changed, handle 4 may be loosened to allow adjustable yoke 26A to be adjusted as desired by the operator. Also employed is a clutch washer 7 of soft durable material. Clutch washer 7, when pressed tightly against adjusting tilt panel 23 locks adjustable yoke 26A at any position along slot 38. When tightened with less pressure, clutch washer 7 allows the operator to override the locking action, adjusting the football's height trajectory quickly between throws. Upper tube 25 over swivel shaft 19, when combined with pivot point 44 form a gimbal allowing the machine to be in balance, with the ability to be pivoted 360 degrees to throw the ball in any desired direction.

Figure 5:
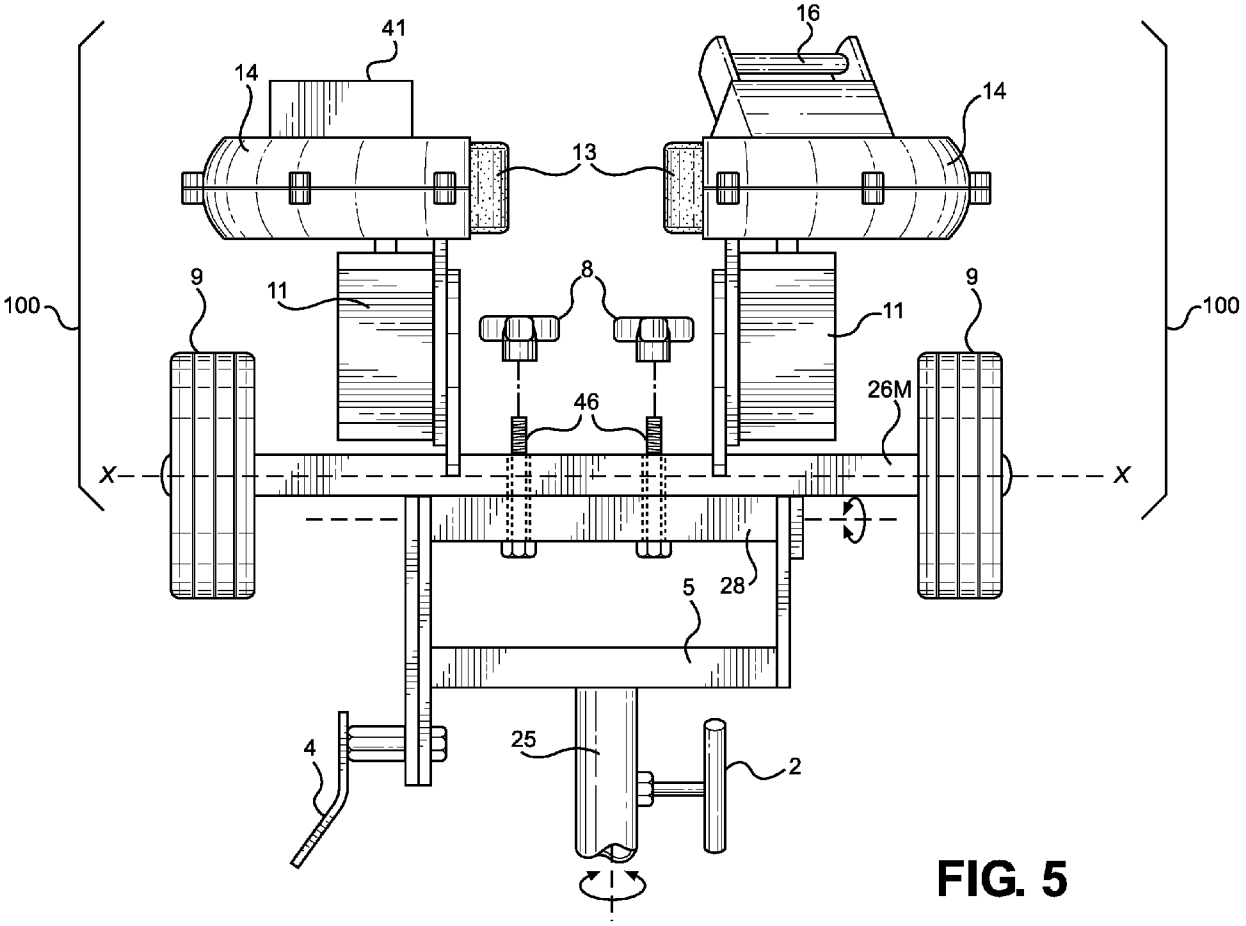
FIG. 5 is a rear view showing the lower detachable frame of the system to pitch balls.

FIG. 5 is a rear view showing the lower frame detachment on the system to pitch footballs. Two throwing head bolts 46 allow for removal of throwing head 100 (portion shown in brackets) to facilitate transporting and removal of throwing head 100 for snaps at ground level. The detachment occurs between mobility yoke 26M along the dashed line x-x between cross tube 28 and throwing head 100. Throwing head bolts 46 are affixed to the bottom side of cross tube 28 and pass through mobility yoke 26M and are secured by wing nuts 8. Detachment of throwing head 100 is required when the machine is converted for snapping, kicking or for transportation. Separation is facilitated by tipping the football pitching machine 101 forward onto safety guards 14 using tilting handles 16. Electronics enclosure 41 is mounted to the top of cover 14 on the left side.

Figure 6:
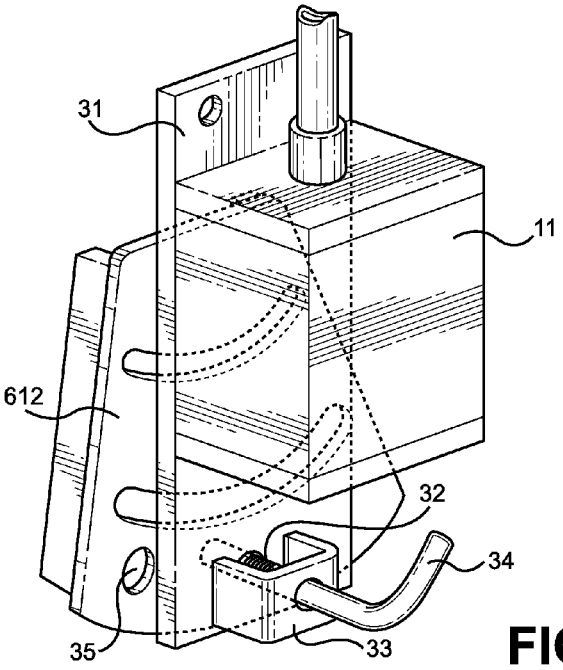
FIG. 6 is a side perspective view of a motor adjustment panel for adjusting the position of a motor on the system to pitch balls.
Figure 7:
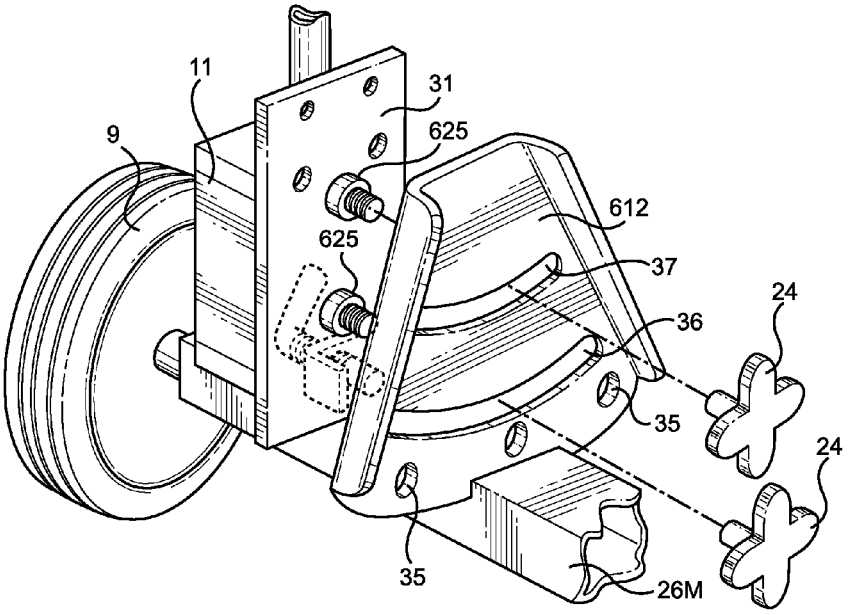
FIG. 7 is another side perspective view of a motor adjustment panel for adjusting the motors on the system to pitch balls.

FIGS. 6 and 7 show opposing side perspective views of a motor adjustment panel 612 for adjusting amount of spin and direction of spin of the ball as it is pitched. Each motor adjustment panel 612 allows one of the two motors 11 on the system to be positioned to pitch footballs using a desired amount of spin and direction of spin. FIGS. 6 and 7 show the method whereby the position of motors 11 may be rotated in an arcuate slot 36, 37 on motor adjustment panel 612. Motors 11 are mounted on motor mounting plate 31. Motor mounting plate 31 in turn mounts on motor adjustment panel 612 by two motor attachment bolts 625 which pass through respective arcuate slots 36, 37 on motor adjustment panel 612. Wing nuts 24 complete the attachment over motor attachment bolts 625. When motor attachment bolts 625 are loosened, motor mounting plate 31 slides along a circumferential portion of arcuate slots, allowing opposing motor 11 to be positioned at different angles. At three points in arcuate paths 36, 37, motors 11 can be locked in place by lock spring 32 on loaded locking pin 34. It will be recognized that additional locking points can be added. When locking pin 34 is pulled out, motor 11 and motor mounting plate 31 are free to slide. When locking pin 34 is released into holes 35, motor 11 is locked in place. Motor 11 can also be locked, by locking motor angle adjustment wing nuts 24 at any point along the arcuate slots.

Figure 8:
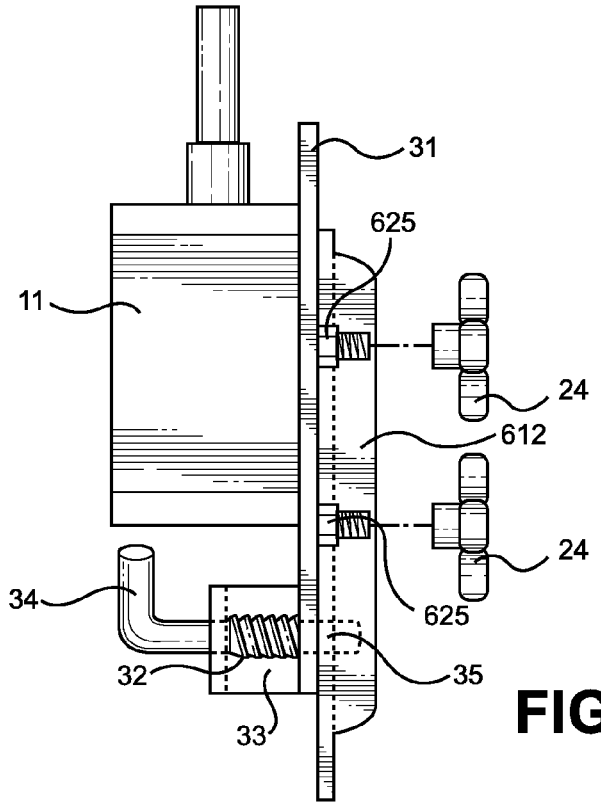
FIG. 8 is a front view of the lock pin for locking the motor adjustment panel on the system to pitch balls.

FIG. 8 is a side view of locking pin 34 for locking motor adjustment panels 612 in place. Locking pin 34 employs spring 32 and lock pin housing 33. Locking pin 34 is inserted when spring 32 is relaxed, causing locking pin 34 to enter any one of three holes 35 in motor adjustment panel 612 thereby locking motor mounting plate 31 and motor 11 into the selected position.

Figure 9:
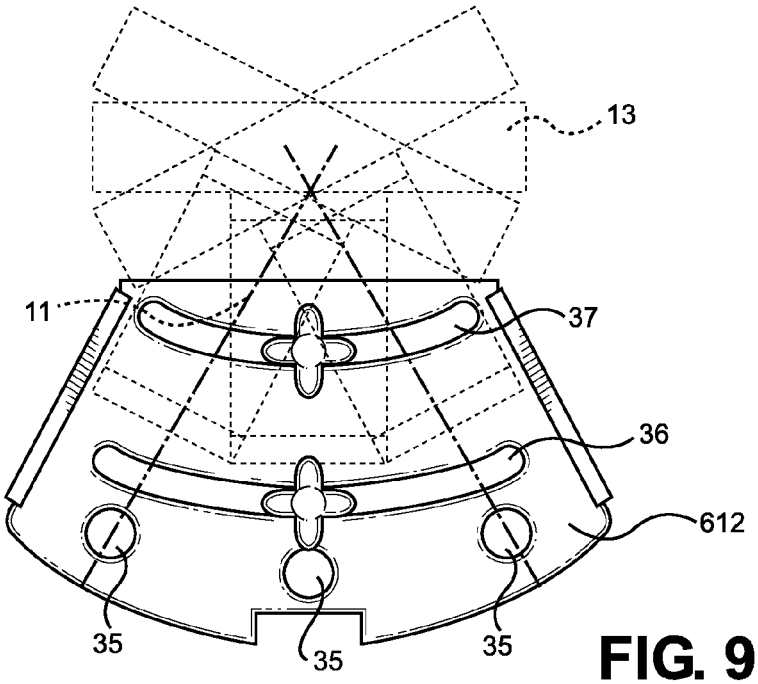
FIG. 9 is a side view of the motor adjustment panel for adjusting the motors on the system to pitch balls.

FIG. 9 is a side view of motor adjustment panel 612 for adjusting motors 11. FIG. 9 shows a throwing wheel 13 at various angles along arcuate slots 36, 37. When opposing motors 11 are locked at different angles, they impel a football with a clockwise or counter-clockwise rotation, causing a spiral throw. Adjustment panel 612 can be locked in place along arcuate slots 36, 37 to control the amount of spiral spin.

Figure 10A:
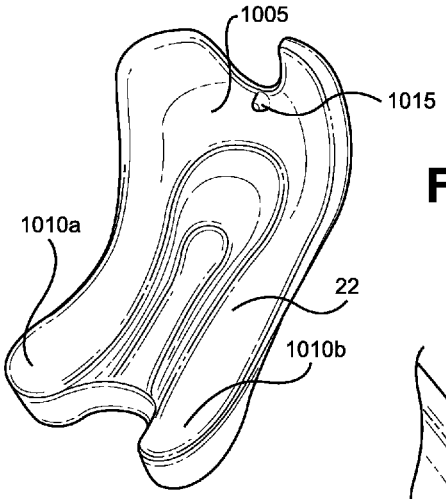
FIGS. 10A-C are several views of the ball cradle.
Figure 10B:
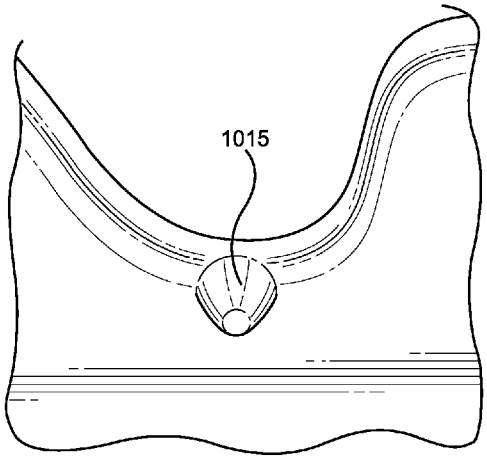
Figure 10C:
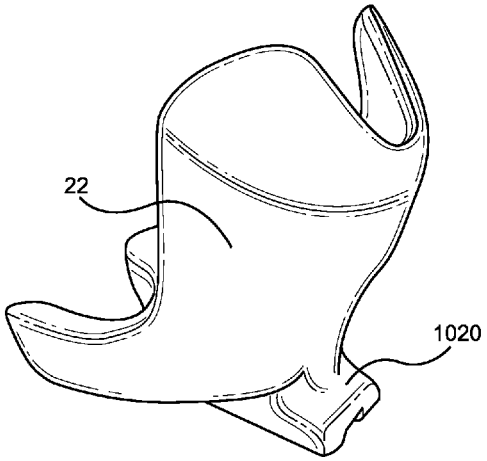

FIGS. 10A-H are views of ball cradle 22 where FIGS. 10A-C show cradle 22 alone and FIGS. 10D-G show cradle 22 with the ball in position for pitching. FIGS. 10H1 and 10H2 show an alternative embodiment for cradle 22 to hold the football in place.

Cradle 22 is formed of rigid material such as metal or hard plastic and is shaped to hold a football in multiple positions and it has a base portion 1020 that is configured to allow slide tube 20 to slide within it. Depending on the orientation of the football, it comes into contact with cradle 22 at different contact points. In an orientation in which cradle 22 holds a football to be passed, the ball fits inside of a rear cap portion 1005 of cradle 22 with the bottom of the ball being held by opposing front cradle arms 1010*a, b*. To secure a football firmly in place within cradle 22, a protruding component such as a nub 1015 or a fin 1017 is positioned in rear cap portion 1005. FIG. 10B1 shows a close-up view of nub 1015. Nub 1015 is long enough to fit within the small recess at the tip of the football where the seams come together to keep the football from sliding out of position when it is launched from football pitching machine 101. Nub 1015 permits the football to be held in the same position for each pass so that each pass pitched from football pitching machine 101 at any given setting is reliably consistent in terms of the distance, spiral and trajectory.

Figure 10D:
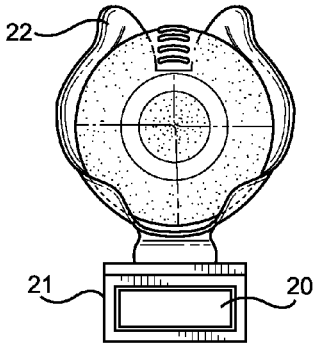
Figure 10E:
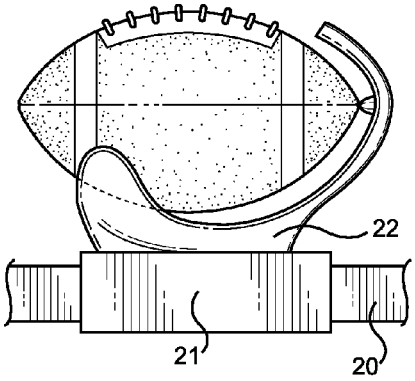
Figure 10F:
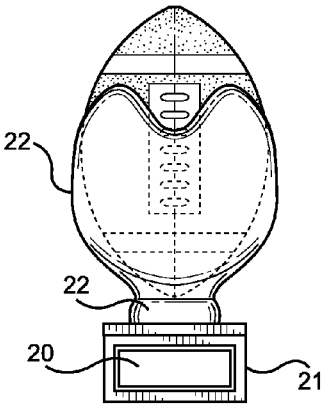
Figure 10G:
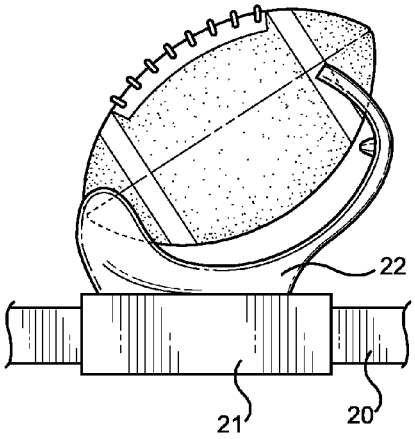

Cradle 22 is shaped to hold a football at different angles. The football will be thrown with a spiral action when introduced into throwing wheels 13 when held in a horizontal position as shown in FIGS. 10D and 10E. When held by cradle 22 at approximately the same 45-degree angle as shown in FIGS. 10F and 10G, the football will be thrown with an end over end action. The angle of the football can be changed to simulate various kick-offs, such as onside kicks. Cradle 22 slides along slide tube 20 to introduce ball 24 into a chute formed between throwing wheels 13.

FIGS. 10H1 and 10H2 show a side view and a front view of an alternative embodiment of cradle 22 that uses one or more fins 1017 instead of nub 1015 to hold the ball in consistent placement for introduction to chute between throwing wheels 13. Fin 1017 may be one or more linear elements that line up and engage one or more seams on the ball at or near the end of the ball. Unlike nub 1015 which may be formed of a rigid material, fin 1017 could be made of flexible plastic, rubber or another flexible material that would bend out of the way as the football is engaged by throwing wheels 13 and spin is imparted to the ball.

Figure 11:
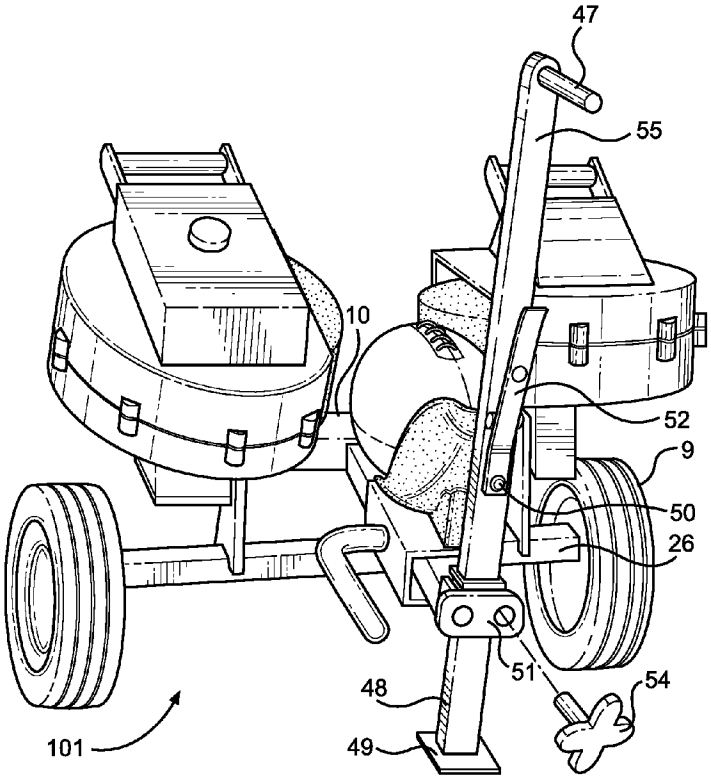
FIG. 11 is a topside perspective view of the system to pitch balls configured in a snapping position.

FIG. 11 is a topside perspective view of a throwing head configured in a snapping position where the football is snapped from ground level. Throwing head 100 is separated from socketing frame 40 and legs 1 and placed on the ground in position to snap the ball simulating the action of a center. A support stand made up of a handle tube 55 sliding on adjustable tube 48 for vertical adjustment control is attached to mobility yoke top panel 10 by pivoting latch 51 which attaches to the end of slide tube 20. At the bottom of adjustable tube 48 is a base 49. A knob 54 controls latch 51 allowing quick removal of handle tube 55. When removed, throwing head may be reassembled onto socketing frame 40 and legs 1 for throwing passes and kicks. When handle tube 55 is attached to mobility yoke 26M, a transporting handle 47 can be used to easily roll football pitching machine 101 on caddy wheels 9.

Figure 12:
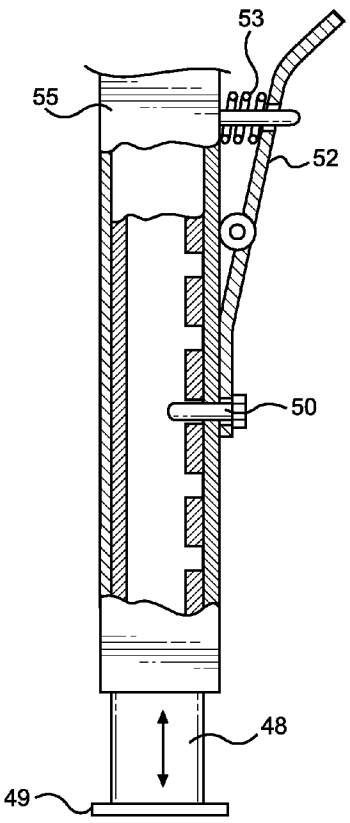
FIG. 12 is a perspective view of the height control of the system to pitch balls when in a snapping position.

FIG. 12 is a perspective close-up view of the height control of football pitching machine 101 when in a snapping position. This illustration shows the method whereby the trajectory of the centered football can be raised or lowered. Handle 52 may be pushed against handle tube 55 such that spring 53 lifts push button 50 releasing handle tube 55 to slide up or down thereby raising or lowering handle tube 55 on adjustable tube 48. By releasing handle 52, push button 50 is reinserted into a desired one of the selectable holes in handle tube 55.

Figure 13:
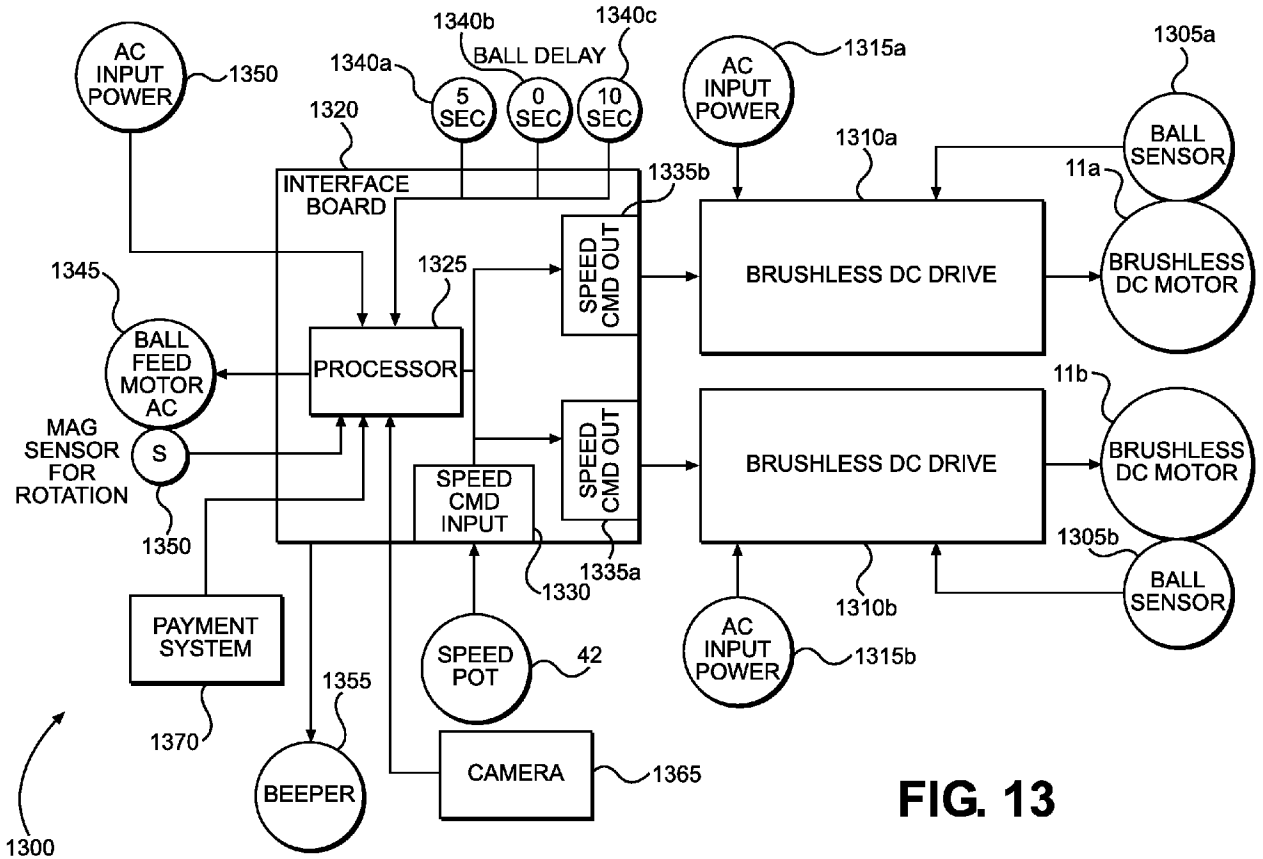
FIG. 13 is a block diagram of the electronics for controlling the motors on the system to pitch balls.

FIG. 13 is a block diagram of the electronics 1300 for controlling each of the two variable speed motors 11 on the system to pitch balls. Motors 11 may be brushless direct current ("DC") motors. On each motor 11 is a ball sensor 1305 that detects a ball passing between throwing wheels 13. Detection of a ball at sensors 1305 causes a feedback signal to be transmitted to a brushless DC drive 1310 for each motor that causes brushless motor 11 to spin. Power is supplied to each brushless DC drive 1310 at an alternating power outlet 1315. Both motors 11*a, b* are connected to an interface board 1320 having a processor 1325 that receives input from various sources and transmits instructions to control motors 11. Interface board 1320 includes speed controls for outputting signals to brushless DC drives 1310 to control the speed at which the drives turn motors 11, to thereby impact the speed and distance of the ball when it is thrown. The speed controls are made up of a speed input 1330 which receives signals from a speed knob 42 that is adjusted by a user. A pair of speed outputs 1335*a, b* transmit signals from processor 1325 to brushless DC drives 1310*a, b*. By using a single processor to control both motors 11, the operation of motors 11 may be synchronized for speed settings. Synchronization of the motors adjusts motors 11 to operate at the same speed resulting in a tighter spiral when the ball is pitched. In addition, feedback from both motors 11 by sensors 1305 to processor 1325 allows for adjustments to both motors 11 to maintain synchronization of motors 11.

A set of time interval switches 1340*a-c* are used to set the time of the delay between pitches of the ball. It should be understood that more or fewer interval time switches may be incorporated in the football pitching machine 101 depending on the needs of the user. Football pitching machine 101 may alternatively be equipped with an automatic ball feeder. The automatic ball feed motor 1345 is used to automatically feed balls for pitching and further includes a magnetic sensor 1350 for detecting direction. An AC power line 1355 plugs into a standard AC outlet to supply power to the electronics 1300. A beeper 1360 is used to indicate that a ball is going to be pitched within the number of seconds of the interval selected.

Sensors 1305 may also be connected to processor 1325 so that data related to the operation of motors 11 may be monitored and analyzed by processor 1305. If the data analyzed by processor 1305 indicates any problems, for example, related to excessive heat, vibration or resistance, beeper 1355 may be sounded indicating to the operator that there is need for adjustment. It should also be understood, that the data related to motors 11 may be collected and stored in a memory (not shown) to track the history of operation of the motors for maintenance purposes.

A camera 1365 is in communication with processor 1325 to capture either or both still images and/or video recordings of players receiving balls pitched by ball pitching machine 101. Processor 1325 can transmit signals to camera 1365 at any proper time to turn on from a time prior to a ball being pitched through and including a time period for reception of a pitch. A series of still images or a video recording may later be reviewed and analyzed by coaches and players so that a player can improve different aspects of play. The images may be stored on camera 1365 or in a memory connected to processor 1325 where they may be accessed through a connection port such as a standard USB port, or connected for transmission over a network as desired by a user.

In addition to being connected to a camera 1365 to record images, electronics 1300 may also include a payment system 1370 by which a user may pay to use ball pitching machine 101. Payment system 1370 includes a bill validator 1375 for accepting payment in the form of currency. Alternatively, or in addition, payment system 1370 may include a card acceptor for accepting credit, debit, smart or other types of cards that allow a user to make payment for use of ball pitching machine 101. Once payment has been accepted, electronics 1300 are activated to allow the user to set machine 101 as desired and to receive pitched balls. It should be understood, that payment may be time based, such as for example, 30 minutes or use for $25. A user may also be charged on a per pitch basis at the discretion of the operator. Interface board 1320 through processor 1325 controls ball pitching machine to track the time in use (e.g. by the hour, minute, or for an event such as a party) or the amount of pitches purchased. Once a user has used his allotted time or pitches, further payment must be made to continue play. Systems for making payment as described are known in the art for use of baseball pitching machines.

While the invention has been described with respect to the FIGS. 1-13, it will be appreciated that many modifications and changes may be made by those skilled in the art without departing from the spirit of the invention. For example, the ball positioning component that is nub 1015 or a fin 1017 may be a combination of a nub 1015 and/or one or more fins 1017 that are positioned in a linear direction away from nub 1015. Two fins 1017 may be used in an X-pattern to engage the two sets of seams of a football in that are perpendicular to each other. Alternatively, any combination of one, two, three or four fins could be used to engage the seams at the end of the football. Additionally, spring type locking pins have been described for adjusting and maintaining the position of different components of the football pitching machine during operation. However, other types of adjustment mechanisms could be used such as clips, straps or any number of other such mechanisms known in the art. Any variation and derivation from the above description and drawings are included in the scope of the present invention as defined by the claims.

The invention claimed is:

1. A method of pitching an oblong shaped ball from a ball pitching machine, comprising;

positioning a first propelling wheel and a second propelling wheel on a frame wherein the first propelling wheel and the second propelling wheel are opposed with respect to each other;

adjusting the speed and position of the first and second propelling wheels to impart a desired level and direction of spin to the oblong shaped ball passing between the first and second propelling wheels;

selectably locking said first propelling wheel along a first arc at a desired position;

selectably locking said second propelling wheel along a second arc at a desired position;

spinning the first propelling wheel powered by a first motor;

spinning the second propelling wheel powered by a second motor;

selecting a ball cradle to present the oblong shaped ball between the first propelling wheel and the second propelling wheel wherein the ball cradle has a ball positioning component engaging the oblong shaped ball in at least one seam at or near an end of the oblong shaped ball; and sliding the ball cradle along an element affixed to the frame wherein the element comprises an elongated member with a first end where the oblong shaped ball is placed on the cradle and a second end that is positioned such that when the cradle slides towards the second end, the oblong shaped ball is presented between the first and second propelling wheels to be pitched, wherein the ball cradle comprises:

a base slidably mounted to an element of the ball pitching machine such that the ball cradle slides along the element to present the oblong shaped ball for pitching;

an elongated body mounted on the base, comprising:

a front portion with a front gap formed between two front extending members on either side of the front portion, each front extending member including a front member edge; and a rear portion with a rear gap formed between two rear extending members on either side of the rear portion, each rear extending member comprising:

an end portion that extends above a height of the front extending members; and a rear member edge that extends above a height of a side edge of the body and above a height of the front member edge; and wherein the ball cradle accommodates the oblong shaped ball in at least two positions for pitching including:

a first position in which the oblong shaped ball is situated lengthwise in the ball cradle with a first end of the oblong shaped ball positioned in the rear gap; and a second position in which the oblong shaped ball is situated lengthwise in the ball cradle with a first end of the ball positioned within a space formed by the rear extending members.

2. The method of claim 1, wherein the ball cradle is configured to hold an oblong shaped ball in a first position that is generally horizontal and where the ball positioning component comprises a nub that contacts the end of the oblong shaped ball, and a second position that is generally angled where the oblong shaped ball contacts the ball cradle at a lower forward end with at least two contact points and at an upper rearward end with at least two contact points.

3. The method of claim 1, wherein the ball cradle is configured to hold an oblong shaped ball in a first position that is generally horizontal and where the ball positioning component comprises at least one fin that engage at least one seam at or near the end of the oblong shaped ball, and a second position that is generally angled where the oblong shaped ball contacts the ball cradle at a lower forward end with at least two contact points and at an upper rearward end with at least two contact points.

4. The method of claim 1 further comprising:

operating the first and second motors using a processor configured to set and maintain desired speeds of the motors;

monitoring each of the motors using a sensor and providing a feedback signal to the processor indicating the speed of each motor; and adjusting the speed of each motor so that the motors are synchronized to pitch the oblong shaped ball consistent with the desired level and direction of spin.

5. The method of claim 1 further comprising assessing a fee to a user for use of the ball pitching device wherein payment is set based on one of a group of payment types selected from the group consisting of: (a) pay per pitch; (b) time-based payment; or (c) event based payment.

6. The method of claim 1, wherein data is recorded and the data recorded comprises a level of excessive vibration detected in at least one of the first and second motors.

7. The method of claim 1, wherein data is recorded and the data recorded comprises a level of heat detected in one of the first and second motors.

8. The method of claim 1, wherein data is recorded and the data recorded comprises a level of resistance detected on one of the first and second motors.

9. The method of claim 1, further comprising the step of recording an image with a camera, wherein the camera is in operable communication with a controller at or around the time an oblong shaped ball is pitched, and the resulting image is captured by the camera for later viewing or playback.

10. The method of claim 1, further comprising removing a throwing head component of the frame from a base component to allow the throwing head to be positioned at different heights including at least: a) a first height at or about ground level; and b) a second height at or about a level of a user's arm at a release point of a throwing motion.

11. The method of claim 1, wherein the oblong shaped ball is pitched generally end-over-end further comprising presenting the oblong shaped ball in the ball cradle in a substantially vertical orientation wherein the oblong shaped ball contacts the ball cradle at a lower forward end and at an upper rearward end.

12. The method of claim 1 wherein the cradle is configured to hold an oblong shaped ball in a number of positions, including at least: 1) an end-over-end position; 2) a simulated passing spiral position; 3) a simulated spiral kick position; and 4) a snap position.

13. A cradle that holds an oblong shaped ball in at least two positions for presentation to a ball pitching machine, the cradle comprising:

a base slidably mounted to an element of the ball pitching machine such that the cradle slides along the element to present the oblong shaped ball for pitching;

an elongated body mounted on the base, comprising:

a front portion with a front gap formed between two front extending members on either side of the front portion, each front extending member including a front member edge; and a rear portion with a rear gap formed between two rear extending members on either side of the rear portion, each rear extending member comprising:

an end portion that extends above a height of the two front extending members; and a rear member edge that extends above a height of a side edge of the elongated body and above a height of the two front member edge; and wherein the cradle accommodates the oblong shaped ball in at least two positions for pitching including:

a first position in which the oblong shaped ball is situated lengthwise in the cradle with a first end of the oblong shaped ball positioned in the rear gap; and a second position in which the oblong shaped ball is situated lengthwise in the cradle with a first end of the oblong shaped ball positioned within a space formed by the two rear extending members.

14. The cradle of claim 13 further comprising a ball positioning component positioned proximate the rear gap and on an interior surface of the two rear portion, wherein in the first position, the ball positioning component is in contact with the oblong shaped ball such that the ball positioning component extends into at least one seam at an end of the oblong shaped ball.

15. The cradle of claim 13 wherein in the first position, the oblong shaped ball contacts the cradle at three points that comprise an edge of each of the two front extending members and the ball positioning component, and in the second position, the oblong shaped ball contacts the cradle at four points that comprise an interior surface of each of the two front extending members and an edge of each of the two rear extending members.

16. The cradle of claim 13 further comprising a channel in the base of the cradle wherein the cradle slides on the base to present the oblong shaped ball to the ball pitching machine.

17. The cradle of claim 14 wherein the ball positioning component is in a shape selected from the group consisting one or more of: (a) a cone; (b) a pin; (c) a fin; or (d) a hole in the rear portion of the cradle.

18. The cradle of claim 13 wherein when the oblong shaped ball is in the first position, a top edge of each of the two front extending members is below a horizontal plane aligned with a center axis running through a lengthwise center axis of the ball.

19. The cradle of claim 13 wherein when the oblong shaped ball is in the first position, a surface area at a midpoint of each side of the oblong shaped ball in the a height dimension running the a length of the oblong shaped ball on either side is exposed.

20. The cradle of claim 13 wherein the cradle accommodates the oblong shaped ball in at least two positions for pitching, including:

a first position in which the oblong shaped ball is situated lengthwise in the cradle with a first end of the oblong shaped ball positioned in the rear gap; and a second position in which the oblong shaped ball is situated lengthwise in the cradle with a first end of the oblong shaped ball positioned within a space surrounded by the rear extending members.

21. The cradle of claim 13 wherein each end portion on the two rear extending members is curved upwardly.

22. A cradle that holds an oblong shaped ball in at least two positions for presentation to a ball pitching machine, the cradle comprising:

a base slidably mounted to an element of the ball pitching machine such that the cradle slides along the element to present the oblong shaped ball for pitching; and an elongated body mounted on the base, comprising:

a front portion with a front gap formed between two front extending members on either side of the front portion; and a rear portion with a rear gap formed between two rear extending members on either side of the rear end, each rear extending member comprising:

an end portion that extends above a height of the two front extending members and back over a lower portion of the cradle; and a rear extending member edge that extends above a height of a side edge of the elongated cradle and above a height of the front member edge;

wherein the cradle accommodates the oblong shaped ball in at least two positions for pitching, including:

a first position in which the oblong shaped ball is situated lengthwise in the elongated cradle with a first end of the ball extending beyond the front gap and a surface of the oblong shaped ball proximate the first end in contact with each of the two front extending members and a second end of the oblong shaped ball positioned within a rear space at the second end of the body formed by the two rear extending members; and a second position in which the oblong shaped ball is situated lengthwise in the elongated cradle with a first end of the oblong shaped ball positioned within the front gap between the two front extending members and a second end of the oblong shaped ball extending beyond the rear gap and a surface of the oblong shaped ball proximate the second end in contact with each of the two rear extending members.

23. The apparatus of claim 22 further comprising a ball positioning component positioned proximate the rear gap and on an interior surface of the rear portion, wherein in the first position, the ball positioning component contacts the oblong shaped ball such that the ball positioning component extends into at least one seam at a second end of the oblong shaped ball.

24. The apparatus of claim 23 wherein in the first position, the cradle contacts the oblong shaped ball at three points that comprise an edge of each of the two front extending members and the ball positioning component, and in the second position, the oblong shaped ball contacts the elongated cradle at four points that comprise an interior surface of each of the two front extending members and an edge of each of the two rear extending members.

25. The apparatus of claim 22 further comprising a channel in the base wherein the elongated body slides on the base to present the oblong shaped ball to the ball pitching machine.

26. The apparatus of claim 23 wherein the ball positioning component is in a shape selected from the group consisting one or more of: (a) a cone; (b) a pin; (c) a fin; or (d) a hole in the rear portion of the elongated body.

27. The apparatus of claim 22 wherein when the oblong shaped ball is in the first position, a top edge of each of the two front extending members is below a horizontal plane aligned with a center axis running through a lengthwise center axis of the oblong shaped ball.

28. The apparatus of claim 22 wherein when the oblong shaped ball is in the first position, a surface area at a midpoint of each side of the oblong shaped ball in a height dimension running the length of the oblong shaped ball on either side is exposed.

29. The apparatus of claim 22 wherein each end portion on the two rear extending members is curved upwardly.

* * * * *